United States Patent [19]

Bueno et al.

[11] Patent Number: 4,777,879

[45] Date of Patent: Oct. 18, 1988

[54] FUZE FOR AN EXPLOSIVE SHELL

[75] Inventors: Leconcio M. Bueno, Zaragoza; Rafael G. Perez, Madrid, both of Spain

[73] Assignee: Instalaza, S.A., Madrid, Spain

[21] Appl. No.: 35,794

[22] Filed: Apr. 8, 1987

[30] Foreign Application Priority Data

Apr. 8, 1986 [ES] Spain ..... 553.784

[51] Int. Cl.[4] ..... F42C 15/04; F42C 15/12; F42C 15/20; F42C 15/26

[52] U.S. Cl. ..... 102/226; 102/230; 102/489; 102/393

[58] Field of Search ..... 102/226, 227, 229, 230, 102/489

[56] References Cited

U.S. PATENT DOCUMENTS

| | | | |
|---|---|---|---|
| 2,750,888 | 6/1956 | Wynn | 102/226 |
| 2,817,295 | 12/1957 | Wylie | 102/226 |
| 3,902,423 | 9/1975 | Reams et al. | 102/226 |
| 3,926,122 | 12/1975 | Wolterman | 102/226 |
| 3,998,164 | 12/1976 | Hadfield | 102/226 |
| 4,455,940 | 6/1984 | Furuike | 102/228 |
| 4,653,401 | 3/1987 | Gatti | 102/226 |

*Primary Examiner*—David H. Brown

*Attorney, Agent, or Firm*—Mason, Fenwick & Lawrence

[57] ABSTRACT

A fuse for an explosive shell comprises a body having a longitudinal axis, a hood unit fitting over the body and movable along the body vertical axis between a first position and a second position, and a parachute linked to the hood unit for pulling the hood unit from its first position to its second position when the explosive shell is released. A slide catch is housed in the body and is moveable in a direction perpendicular to the body perpendicular axis from an unprimed to a primed position. A primary detonator is housed in the slide catch. The primary detonator is out of alignment with the main charge of the explosive shell when the slide catch is in its unprimed position, and is in alignment with the main charge of the explosive shell when the slide catch is in its primed position. A safety catch holds the slide catch in its unprimed position until it is released by inertial forces acting on the fuze. A firing pin detonates the primary detonator. The firing pin has an upper portion fixedly housed in the hood unit and a lower portion slidably housed in the body. The lower portion is moveable along the body longitudinal axis between a first and a second position in response to the movement of the hood unit between its first and second positions.

9 Claims, 3 Drawing Sheets

166
170
174
172
20
168
140
138
110
136
142
146
144
148
58
54a
56
62
68
64
54
66
70
76
72
132
50
128
130
78
74
126
88
54b
16
86
90
48a
134
48
111
48b
108
120
124
112
108a
122
32
34
100
49
92
46
98
106
108b
24
96
106b
44
94
104
106a
38
42
102
118
26
114
36
30
182
184
180
22
160
154
10
14
158
165
156
164
152
178
176
18

FIG-3
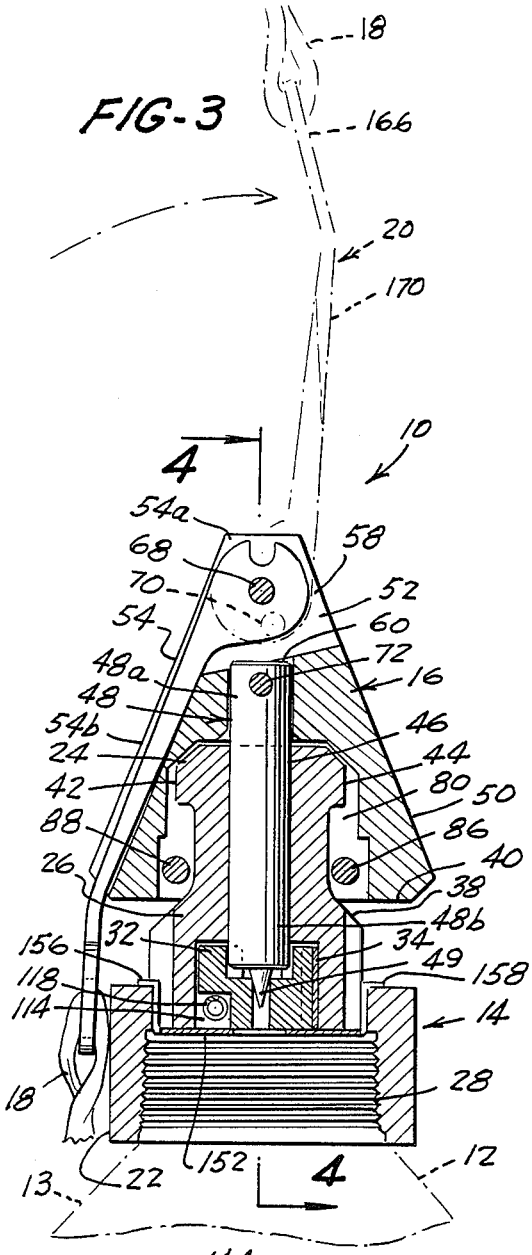
FIG-5
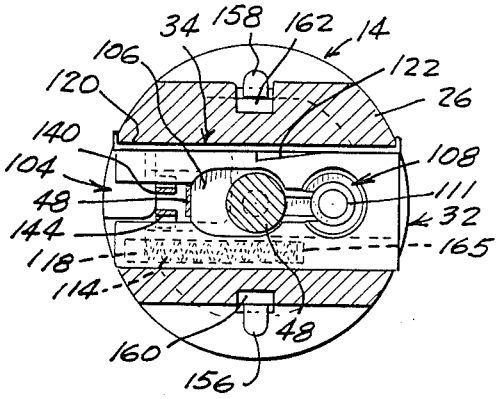
FIG-4
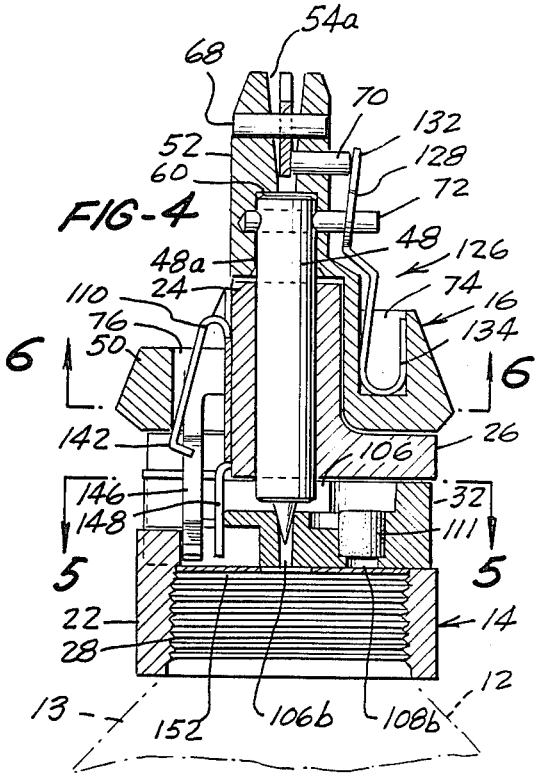
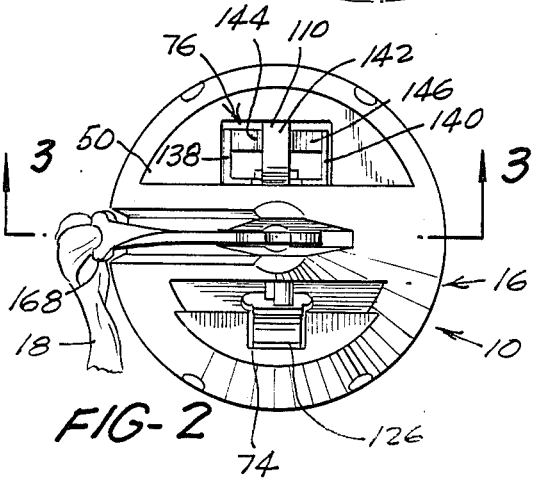
FIG-2
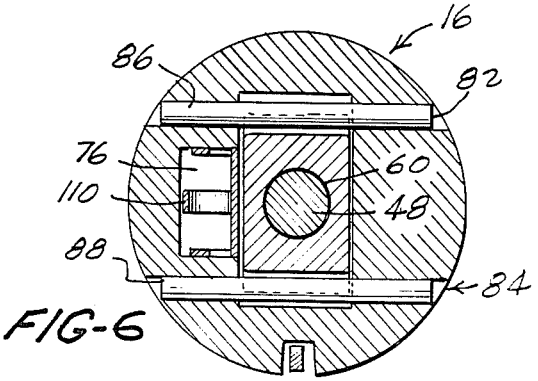
FIG-6

18
168
20
170
54a
68
166
70
60
54b
72
52
16
48
48a
80
46
24
44
42
86
50
88
36
48b
38
26
49
30
108a
32
34
118
110
22
114
152
28
14
13
12
184
120
122
96
34
14
32
102
100
104
150
165
116
10
114
30
92
98
108
166
58
56
68
70
16
132
52
126
72
48a
128
60
74
80
134
24
76
48
49
26
48b
108a
106a
32
111
9
9
106b
30
22
14
13

FUZE FOR AN EXPLOSIVE SHELL

BACKGROUND OF THE INVENTION

The present invention is directed to a fuze for an explosive shell designed specifically, although not exclusively, for submunitions or small bombs, such as grenades, carried by a carrier vector such as a rocket, artillery grenade, mortar shell, or other projectile.

The fuze to which the present invention is directed constitutes an original idea with substantial improvements regarding operation and structural simplification over other designs such as, for example, those referred to in Spanish Pat. No. 538,267.

SUMMARY OF THE INVENTION

A fuse for an explosive shell according to the invention comprises a body, a hood unit fitting over the body and movable along the vertical axis of the body between a first position and a second position, and a tape parachute for moving the hood unit from its first position to its second position when the explosive shell is released from its carrier vector. A slide catch is housed in the body, which is moveable perpendicular to the longitudinal axis of the body from an unprimed to a primed position. A primary detonator is housed in the slide catch. The primary detonator is out of alignment with the main charge of the explosive shell when the slide catch is in its unprimed position, and is in alignment with the main charge when the slide catch is in its primed position. A safety catch holds the slide catch in its unprimed position until the inertial forces acting upon the safety catch move it to its second position. The primary detonator is detonated by a firing pin. The firing pin has an upper portion fixedly housed in the hood unit and a lower portion slidably housed in the body, the lower portion being movable along the longitudinal axis of the body between a first and a second position in response to the movement of the hood unit between its first and second position.

In one aspect of the invention, the slide catch is urged into its primed position by a spring housed in the slide catch, and movement of the slide catch along its longitudinal axis to its primed position is limited by a protuberence on the slide catch which engages a corresponding protuberence on the body. In another aspect of the invention, the fuze further comprises a locking catch housed in the body adjacent the slide catch, and the slide catch includes a notch on the side adjacent the locking catch for engaging the locking catch when the slide catch is in its primed position.

In still another aspect of the invention, the firing pin includes a point at its lower end which is housed in the slide catch, and acts in conjunction with the safety catch to hold the slide catch in its unprimed position until the safety catch is released and the hood unit moves to its second position upon expulsion of the bomb from the carrier vector.

In still another aspect of the invention, the tape parachute is carried on a carrier rod rotatably mounted in the hood unit between an unprimed and a primed position, the hood unit including a locking bolt for locking the carrier rod in its primed position. The parachute can include a curved element for holding a portion of the parachute in an open position to aid in aerodynamic breaking by the parachute and to house the rest of the parachute when the fuze is in its unprimed condition.

A better understanding of the disclosed embodiment of the invention will be achieved when the accompanying detailed description is considered in conjunction with the appended drawings, in which like reference numerals are used for the same parts as illustrated in the different figures.

BRIEF DESCRIPTION OF THE DRAWINGS

FIG. 2 is a top plan view of the invention shown in FIG. 1;

FIG. 3 is a cross-sectional view taken along line 3—3 of FIG. 2.

FIG. 4 is a cross-sectional view taken along line 4—4 of FIG. 3.

FIG. 5 is a cross-sectional view taken along line 5—5 of FIG. 4;

FIG. 6 is a cross-sectional view taken along line 6—6 of FIG. 4;

DESCRIPTION OF THE PREFERRED EMBODIMENT

Figure 1:
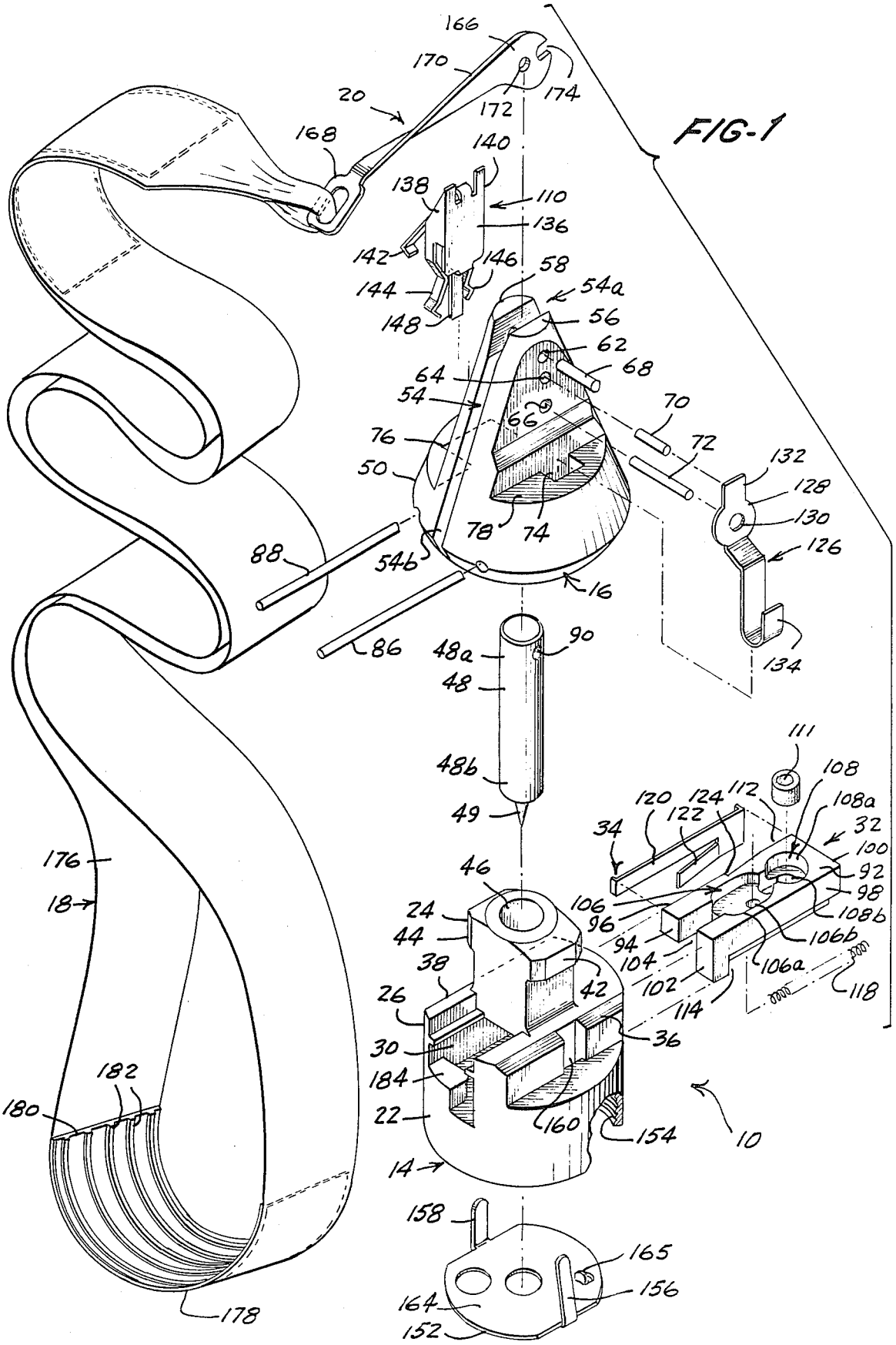
FIG. 1 is an exploded, perspective view of a preferred embodiment of the invention.
Figures 7, 8, 9:
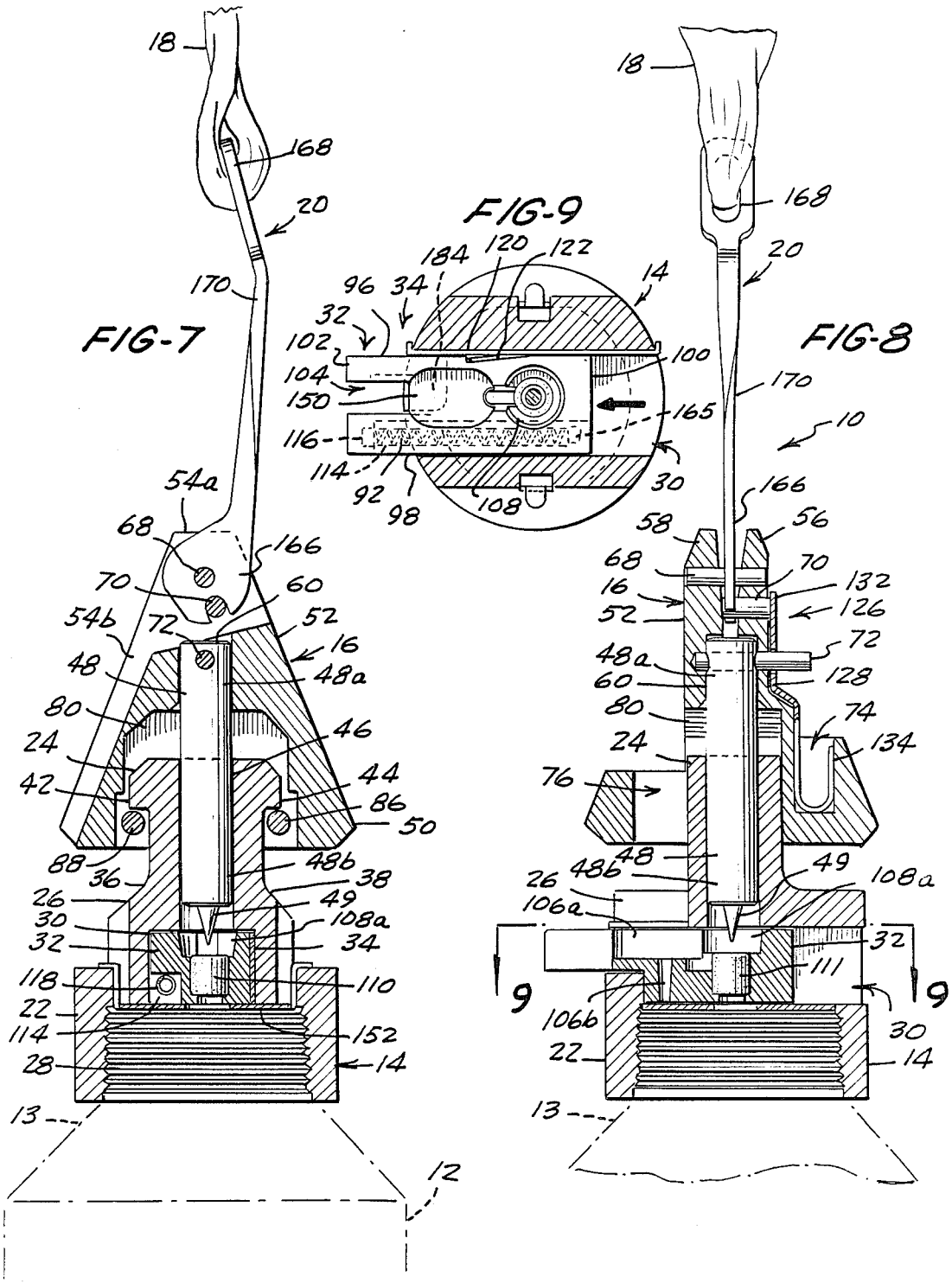
FIG. 7 is a cross-sectional view corresponding to FIG. 3, but showing the fuze in its primed condition.
FIG. 8 is a cross-sectional view taken along line 8—8 of FIG. 7.
FIG. 9 is a cross-sectional view taken along line 9—9 of FIG. 8.

Referring now to FIGS. 1-9, there is shown a fuze generally designated by the reference numeral 10 for use with an explosive shell such as a grenade or small bomb 12 or the like.

Fuze 10 has a longitudinal axis colinear with the longitudinal axis of the grenade and comprises a body 14, a hood unit 16 fitting over body 14, a parachute 18, and a carrier rod 20 attaching parachute 18 to hood unit 16. Body 14 and hood unit 16 both have longitudinal axes colinear with the longitudinal axis of fuze 10.

Body 14 includes a base section 22, a top section 24, and a center section 26 intermediate base and top sections 22 and 24.

It should be understood that all directional and positional terms such as bottom, top, up, down, and outwards or sideways are purely arbitrary, bottom referring to that part of fuze 10 immediately adjacent the top of grenade 12, upward referring to the direction longitudinally away from grenade 12, and all other terms being defined relative thereto.

Base section 22 is substantially cylindrical and is internally threaded to engage external threads 28 on top 13 of grenade 12. Center section 26 includes in the bottom portion a central channel 30 having a longitudinal axis perpendicular to the longitudinal axis of body 14 and having a generally rectangular lateral cross-section for receiving a slide catch 32 and a two-pronged locking catch 34, to be described in detail hereinafter. The top of center section 26 is defined by a pair of opposed, inwardly extending shoulders 36 and 38 which support the bottom 40 of hood unit 16 when hood unit 16 is in its first position. The top section 24 of body 14 extends upwardly from shoulders 36 and 38, terminating in a pair of opposed shelves 42 and 44 extending outwardly over shoulders 36 and 38 respectively. Top section 24 includes a cylindrical axial bore 46 extending into the upper portion of center section 26 and communicating with central channel 30 for receiving the bottom portion 48*b* of a cylindrical firing pin 48, also to be described in detail hereinafter.

Hood unit 16 comprises a substantially conic base 50 and a substantially triangular upstanding lug 52. Lug 52 has a notch 54 formed therein having an upper portion 54*a* extending across the top of lug 54 to form first and second opposed ears 56 and 58, and a lower portion 54*b* extending down one side of lug 52 and base 50 to form a recess for housing carrier rod 20.

Lug 52 also has formed therein an axial cylindrical bore 60 immediately below ears 56 and 58 and communicating with upper portion 54*a* of notch 54, and having the same diameter as bore 46 for receiving the upper portion 48*a* of firing pin 48. Lug 52 also has formed therein first, second, and third transverse cylindrical bores 62, 64, and 66. First cylindrical bore 62 extends through the tops of ears 56 and 58 and is perpendicular to the longitudinal axis of body 14 for receiving a pivot bolt 68. Second cylindrical bore 64 is positioned below first cylindrical bore 62. It extends through first ear 56 only of lug 52, and is parallel to first cylindrical bore 62 but laterally offset from the longitudinal axis of body 14 for receiving a locking bolt 70. Third cylindrical bore 66 is positioned below second cylindrical bore 64. It extends through first ear 56 and into second ear 58, and is parallel to first cylindrical bore 62 and intersects the longitudinal axis of body 14, for receiving a pin 72.

Base 50 has formed therein on one side of lug 52 a first rectangular recess 74 in the upper surface 78 of base 50 and a second rectangular recess 76 formed on the opposite side of lug 52 and extending all the way through base 50.

An axial central recess 80 extends through base 50 and lug 52 of hood unit 16 for receiving top section 24 of body 14. Recess 80 communicates with bore 60, whereby when hood unit 16 is positioned over body 14, bores 46 and 60 will be axially aligned and in communication with each other.

Base 50 also has formed therein first and second spaced-apart, transverse cylindrical bores 82 and 84 communicating with opposed sides of recess 80 to receive first and second cylindrical anchoring bolts 86 and 88, respectively, for a purpose to be described hereinafter.

Firing pin 48 has at its upper end 48*a* a transverse cylindrical bore 90 positioned for alignment with bore 66 to receive pin 72 when fuze 10 is unprimed. Firing pin 48 has at its lower end 48*b* a point 49, for a purpose to be described hereinafter.

Slide catch 32 is moveable in central channel 30 between an unprimed position (FIGS. 2–6) and a primed position (FIGS. 7–9) and has the form of a rectangular parallelopiped having first and second opposed long, wide faces 92 and 94, first and second opposed long, narrow faces 96 and 98, and first and second opposed short, narrow faces 100 and 102. First, second, and third apertures are formed along the longitudinal axis of slide catch 32 to defined first, second, and third housings 104, 106, and 108 therein. First housing 104 is rectangular in shape and is formed in one short, narrow face 102 to receive a four-pronged safety catch 110. Second housing 106 has an elliptical cylindrical upper part 106*a* and a conical lower part 106*b* and is positioned to be coaxial with the longitudinal axis of body 14 when fuze 10 is in its unprimed condition, for receiving point 49 and the adjacent lower end of the lower portion 48*b* of firing pin 48. Third housing 108 has cylindrical upper and lower portions 108*a* and 108*b* and is positioned adjacent second housing 106 on the opposite side from first housing 104. Upper portion 108*a* has substantially the same diameter as firing pin 48 for receiving the end of firing pin 48 adjacent point 49 when fuze 10 is in its primed condition. Lower portion 108*b* has a smaller diameter than upper portion 108*a* and houses a cylindrical detonator 111.

First long, narrow face 96 of slide catch 32 is positioned adjacent two-pronged locking catch 34 and includes a triangular recess 112, for a purpose to be described hereinafter. Second long narrow face 98 and second long, wide face 94 of slide catch 32 have a lengthwise channel 114 formed at the juncture thereof, with a cylindrical aperture 116 at one end of channel 114 for receiving a coil spring 118.

Two-pronged locking catch 34 is formed from a resilient material and includes a long upper finger 120 extending substantially the full length of slide catch 32 and a short lower finger 122 bend laterally inwardly of finger 120, and biased inwardly towards slide catch 32. Lower finger 122 extends beyond the end 124 of recess 112 when fuze 10 is in its unprimed condition.

Locking bolt 70 is locked in place by a spring part 126 when fuze 10 is in its unprimed condition. Spring part 126 is formed from a resilient material and includes an upper part 128 having a circular aperture 130 of substantially the same diameter as pin 72 for receiving pin 72, a finger 132 positioned above aperture for bearing against locking bolt 70, and a U-shaped spring portion 134 extending downwardly below aperture 134 engaging first recess 74 in body 14.

Four-pronged safety catch 110 is formed of a resilient material and comprises a planar main body portion 136, first and second side portions 138 and 140 extending perpendicularly outwardly from main body portion 136, an outer prong 142 extending at an acute angle outwardly and downwardly from the top of main body portion 136, first and second substantially M-shaped side prongs 144 and 146 extending downwardly from first and second side portions 138 and 140, respectively, and a planar inner prong 148 extending from the bottom of main body portion 136. Outer prong 142 engages second recess 76 of base 50, while first and second and inner prongs 144, 146, and 148 engage first housing 104 in slide catch 32 when fuse 10 is in its unprimed condition. In particular, inner prong 148 bears against inner wall 150 of first housing 104.

A locking plate 152 fits within body 14 at the top of internal threads 154, and is locked in place by means of opposed vertical fingers 156 and 158 which engage corresponding opposed vertical apertures 160 and 162, respectively, in body 14. The upper surface 164 of locking plate 152 defines the bottom of central channel 30, to guide slide catch 32 and improve its sliding motion in central channel 30. Upper surface 164 also includes a short vertical finger 165 offset inwardly from the edge of locking plate 164 to retain the end of coil spring 118.

Carrier rod 20 comprises a substantially circular first end 166, a looped second end 168, and an intermediate elongated rod portion 170. First end 166 is pivotably mounted between ears 56 and 58 by means of a central circular aperture 172 which receives pivot bolt 168. First end 166 also includes a circumferential notch or aperture 174 which is aligned with the longitudinal axis of body 14 when fuze 10 is in its unprimed condition. Rod portion 170 is substantially the same length as lower portion 54*b* of notch 54, and is housed therein when fuze 10 is in its unprimed position. Thus, notch 174 is at the top of hood unit 16 when rod portion 170 is within notch 54. When fuze 10 is in its unprimed position, second end 168 of carrier rod 20 extends below hood unit 16 adjacent base and center sections 22 and 26 of body 14. Second end 168 carries parachute 18.

Parachute 18 comprises a looped tape 176 having first and second ends (not shown) overlapped to form a pocket 178 for receiving a curved strengthening element 180 provided with a plurality of parallel, spaced-apart strengthening ribs 182. When fuze 10 is in its unprimed condition, curved element 180 serves as a housing for the wound parachute 18. When fuze 10 is in its primed condition and parachute 18 is open, element 180 has an aerodynamic breaking effect, which permits grenade 12 to reach the ground in a vertical position.

In operation, when grenade 12 is thrown or expelled from its carrier vector, the inertial force acting on fuze 10 causes safety catch 110 to be expelled, releasing side prongs 144 and 146 from their housing 104 in slide catch 32. Outer prong 142 acts as an obstruction to prevent the return of safety catch 110 to its original position. Also parachute 18 unfolds from element 180 and moves backwards, pulling carrier rod 20 and causing it to rotate about pivot bolt 68 until notch 174 is aligned with locking bolt 70. The spring action of spring portion 134 of spring part 126 pushes locking bolt 70 into engagement with notch 174, locking carrier rod 20 in place.

Parachute 18 also pulls hood unit 16 away from body 14 into its second position, so that anchoring bolts 86 and 88 abut the underside of shelves 42 and 44, preventing further separation of hood unit 15 from body unit 14. Hood unit 16 pulls with it safety catch 110 and firing pin 48. Upward movement of firing pin 48 causes point 49 to disengage from its housing 106 and slide catch 32. All components holding slide catch 32 in place against the outward biasing force of coil spring 118 have now been removed. Coil spring 118 thus urges slide catch 32 radially outwardly from body 14, causing detonator 109 to occupy a position under point 49 of firing pin 48. Also once slide catch 32 is displaced, lower finger 122 of locking catch 34 is released, engaging triangular recess 112 on face 96 of slide catch 32 to lock slide catch 32 against return from its displaced position. A circumferential protuberance 184 extending upwardly from base section 22 of body 14 engages inner wall 150 of slide catch 32 to limit the outward radial movement of slide catch 32. Thus it can be seen that carrier rod 20 and parachute 18, acting in conjunction with spring part 126 and locking bolt 70 comprise the priming mechanism or means for fuze 10.

When grenade 12 hits the ground, the inertial force on hood unit 16 displaces it back towards body 14, causing body 14 and hood unit 16 to resume their initial positions with respect to one another. The relative movement of hood unit 16 and body 14 drives point 49 of firing pin 48 into detonator 109, causing detonator 109 to explode. The explosion of detonator 109 then triggers the explosion of the main charge or subsequent stages of grenade 12.

Thus, it will be seen that the present invention provides a unique method of detonating an explosive shell. While preferred embodiments of the invention have been disclosed, it should be understood that the spirit and scope of the invention are to be limited solely by the appended claims, since numerous modifications of the disclosed embodiment will undoubtedly occur to those of skill in the art.

I claim:

1. A fuze for an explosive shell carried by a carrier vector, the explosive shell having a main charge, said fuze comprising:

a body having a longitudinal axis;

a hood unit fitting over said body and moveable along said body longitudinal axis between a first position and a second position;

priming means for moving said hood unit from its first position to its second position when the explosive shell is released from the carrier vector;

slide catch means housed in said body, said slide catch means having a longitudinal axis perpendicular to said body longitudinal axis and being moveable along said slide catch longitudinal axis from an unprimed to a primed position;

primary detonator means housed in said slide catch means, said primary detonator means being out of alignment with the main charge when said slide catch means is in its unprimed position and in alignment with the main charge when said slide catch means is in its primed position;

safety catch means engaging said slide catch means for holding said slide catch means in its unprimed position and releasable when said hood unit moves to its second position; and firing pin means for detonating said primary detonator means, said firing pin means having an upper portion fixedly housed in said hood unit and a lower portion slidably housed in said body, said lower portion being moveable along said body longitudinal axis between a first and a second position in response to the movement of said hood unit between its first and second position.

2. The fuze of claim 1, said fuze further comprising biasing means housed in said slide catch means for urging said slide catch means into its primed position when said safety catch means is released; and said body including limiting means for engaging said slide catch means in its primed position to prevent its movement beyond its primed position.

3. The fuze of claim 2, said fuze further comprising locking catch means positioned adjacent said slide catch means for engaging said slide catch means in its primed position to prevent its return to its unprimed position.

4. The fuze of claim 1, said slide catch means including a housing therein for housing said lower portion of said firing pin when said lower portion is in its first position and said slide catch is in its unprimed position, said lower portion of said firing pin in said housing acting to lock said slide catch in its unprimed position.

5. The fuze of claim 3, said slide catch means including a housing therein for housing said lower portion of said firing pin when said lower portion is in its first position and said slide catch is in its unprimed position, said lower portion of said firing pin in said housing acting to lock said slide catch in its unprimed position.

6. The fuze of claim 1, said priming means comprising a carrier rod having first and second ends, said first end being attached to said hood unit and rotatable from an unprimed position to a primed position, parachute means attached to said second end of said carrier rod for pulling said carrier rod from its unprimed position to its primed position when the explosive shell is released from the carrier vector, and spring-biased locking means housed in said hood unit for locking said carrier rod in its primed position.

7. The fuze of claim 6, said first end of said carrier rod having an aperture therein and said spring-biased locking means comprising locking bolt means positioned in said hood unit for alignment with said aperture when said carrier rod is in its primed position and spring part means for urging said locking bolt means into said aperture.

8. The fuze of claim 6, said parachute means comprising a looped tape.

9. The fuze of claim 8, said tape having a pocket formed therein and said parachute means further comprising a relatively rigid curved element housed in said pocket for aiding in aerodynamic braking by said parachute means.

* * * * *